United States Patent [19]

Dolce

[11] Patent Number: 4,484,450

[45] Date of Patent: Nov. 27, 1984

[54] HIGH EFFICIENCY REFRIGERATION SYSTEM

[75] Inventor: Augustine J. Dolce, Tonawanda, N.Y.

[73] Assignee: Niagara Frontier Services, Buffalo, N.Y.

[21] Appl. No.: 430,766

[22] Filed: Sep. 30, 1982

[51] Int. Cl.[3] ..... F25D 17/06; A47F 3/04

[52] U.S. Cl. ..... 62/89; 62/256

[58] Field of Search ..... 62/255, 256, 257, 89

[56] References Cited

U.S. PATENT DOCUMENTS

| | | | |
|---|---|---|---|
| 3,063,252 | 11/1962 | Lamb | 62/255 |
| 3,180,109 | 4/1965 | Kimmel | 62/255 |
| 3,304,736 | 2/1967 | Brennan et al. | 62/256 X |
| 3,675,440 | 7/1972 | Ibrahim | 62/256 X |
| 3,812,684 | 5/1974 | Brown | 62/256 X |
| 3,852,974 | 12/1974 | Brown | 62/79 |
| 4,034,572 | 7/1977 | Morris et al. | 62/256 |
| 4,077,228 | 3/1978 | Schumacher et al. | 62/256 |
| 4,151,724 | 5/1979 | Garland | 62/175 |
| 4,176,525 | 12/1979 | Tucker et al. | 62/238 R |
| 4,285,205 | 8/1981 | Martin et al. | 62/113 |
| 4,311,498 | 1/1982 | Miller | 62/181 |
| 4,313,307 | 2/1982 | Sisk | 62/79 |

*Primary Examiner*—Lloyd L. King

*Attorney, Agent, or Firm*—Christel, Bean & Linihan

[57] ABSTRACT

A refrigeration system utilizing cooled spillover air from a refrigerated display case 10, the spillover air being recovered and removed from the ambient space through openings 9. The recovered spillover air is conducted through conduit 29 in heat exchange relation to a subcooler 33, lowering the temperature of refrigerant passing to the display case evaporator 19, the still cool spillover air then being used in a space air conditioning system 30.

12 Claims, 2 Drawing Figures

HIGH EFFICIENCY REFRIGERATION SYSTEM

BACKGROUND OF THE INVENTION

This invention relates to refrigeration systems, and more particularly to an improved, more highly efficient refrigeration system for refrigerated display cases wherein at least a portion of the cooled air which spills from the refrigerated display cases is utilized to subcool liquid refrigerant prior to expansion in the system.

In recent years the escalating cost of energy has caused additional attention to be focused on improving the efficiency of energy consuming systems of various types. The impetus to reduce costs by reducing energy consumption has carried over to retail supermarket operations, wherein significant amounts of energy are consumed in providing continuous refrigeration for dairy, meat, and other perishable products including frozen foods and related items. In addition, the modern supermarket includes a year-round air conditioning system to maintain proper temperature and humidity for the comfort of shoppers.

Such high energy usage equipment provides a fertile field for possible cost savings through the more efficient use of the energy involved. One approach is shown in U.S. Pat. No. 4,285,205, which issued Aug. 25, 1981 to Leonard I. Martin et al., and which discloses a refrigerant subcooling arrangement for use in a refrigeration system having a central compressor and condenser arrangement and a plurality of remotely located evaporators. In the system described in that patent a heat exchanger is provided to permit heat interchange between the warm, liquid refrigerant and the relatively cool, gaseous refrigerant to increase the suction gas temperature of the refrigerant entering the compressor and to subcool the liquid refrigerant before it enters the respective evaporators.

Another approach to the problem of minimizing energy consumption in a supermarket refrigeration and air conditioning system is disclosed in U.S. Pat. No. 4,176,525, granted Dec. 4, 1979 to James M. Tucker et al. In that patent an integrated refrigeration and air conditioning arrangement is disclosed wherein various control arrangements are provided to properly maintain interior conditions regardless of the weather and the season. One aspect of the Tucker et al. disclosure relates to refrigerant subcooling wherein ambient air within the store is passed over an additional condenser to provide cooling of the warmer liquid refrigerant below the temperature at which it exits from the main condenser.

It is an object of the present invention to provide an improved, energy efficient system wherein additional subcooling of the liquid refrigerant is effected without any increase in energy usage in order to improve refrigeration efficiency and thereby reduce operating costs.

BRIEF SUMMARY OF THE INVENTION

Briefly stated, in accordance with one aspect of the present invention there is provided, in conjunction with a refrigeration system having means including a line for conveying liquid refrigerant to at least one evaporator forming part of a refrigerated display case to cool the air therein and thereby cool the products displayed in the case, conduit means arranged to capture the cooled air which normally spills from the refrigerated product display case or cases and conduct it to a subcooling means positioned in the liquid refrigerant conveying means, the subcooling means being arranged in heat exchange relationship with the cooled spillover air. The temperature of the liquid refrigerant is substantially lowered, with only a small increase in the temperature of the spillover air which is utilized in the space air conditioning system for additional savings in energy.

DESCRIPTION OF THE ILLUSTRATED EMBODIMENT

Figure 1:
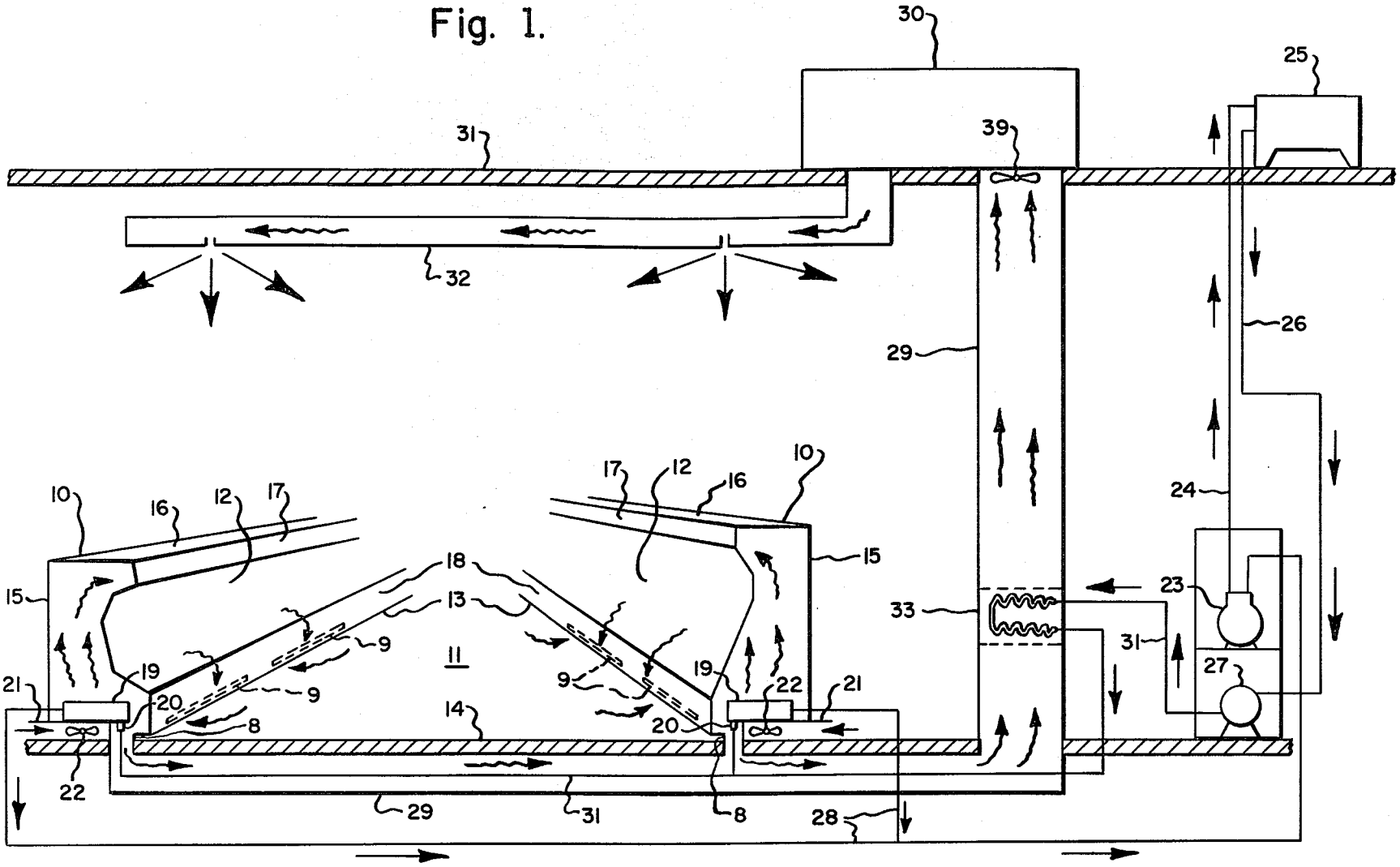
FIG. 1 is a schematic view illustrating one form of refrigeration system in accordance with the present invention utilized in connection with refrigerated display cases of the type commonly found in supermarkets.

Referring now to the drawings, there is shown in FIG. 1 a pair of generally opposed refrigerated display cases 10 positioned on opposite sides of an aisle 11 and of the type often found in supermarkets. Display cases 10 typically contain perishable items which are maintained at a relatively cold temperature above freezing, or may contain frozen juices, vegetables and other perishable food products which are maintained at a temperature below freezing. Additionally, such display cases are also utilized to store and display chilled soft drinks and other beverages normally consumed while cool. Although shown as positioned on opposite sides of an aisle, display cases 10 can, if desired, be arranged on only one side thereof, with either non-refrigerated displays or perhaps closed refrigerator or freezer cases on the other side.

The refrigerated display cases 10 have an opening 12 which faces aisle 11 to permit withdrawal of the products contained therein without the necessity for opening a door. Each case 10 also includes a base portion 13 which rests upon the floor 14 of the store, an upstanding rear wall 15, a top wall 16, which can have a downwardly directed lip 17 at its forward edge as shown, and a front wall 18 which extends upwardly from an elevation spaced above floor 14 to a predetermined height such that the spacing between the top of front wall 18 and the bottom of downwardly directed lip 17 defines open area 12 to thereby expose for sale the products stored within cases 10 in a manner facilitating both loading of and removal from the case and making the displayed items readily available to customers. Each refrigerated display case 10 also includes an evaporator 19 and an expansion valve 20 associated therewith, both of which are of conventional construction and which will be further described hereinafter in connection with the operation of the overall refrigeration system.

The display case cooling effect is provided by a refrigeration system generally shown schematically in FIG. 1. The system includes compressor 23 which compresses gaseous refrigerant to thereby increase both its temperature and its pressure, whereupon the compressed refrigerant in gaseous form is conveyed by means of a suitable conduit 24 to a condenser 25, which is most often in the form of a coil having a forced flow fan (not shown) associated therewith so that ambient air can be passed over the condenser coil and thereby cool the hot refrigerant gas to condense it to the liquid state. The liquid refrigerant then is conveyed by conduit 26 to a refrigerant receiver 27, within which the liquid refrigerant can be collected and stored until needed. As thus far described the refrigerating system is conventional and requires no further explanation.

In a totally conventional system the liquid refrigerant would be conveyed by conduit 31 from receiver 27 directly to expansion valves 20 wherein the liquid refrigerant undergoes a throttling process as a result of which both its temperature and pressure are decreased. The temperature level to which the refrigerant falls is generally considerably below the ambient temperature, and the refrigerant then enters evaporator 19 where the liquid refrigerant absorbs heat from the air entering the display case, thereby cooling it, and in the process it vaporizes and is returned to compressor 23 by means of conduit 28.

The operation of cases 10 is such that refrigerant conveyed thereto as described below absorbs heat while passing through evaporator 19, thereby cooling air which enters case 10 through an inlet duct 21 and which is forcibly driven over coils (not shown) within evaporator 19 by means of a fan 22. The cooled air circulates through and around display cases 10 as indicated by the arrows in FIG. 1 to maintain the temperature of the products displayed therein at a preselected level which is lower than the ambient temperature and which may be either above or below freezing. As a result of such operation and the circulatory flow of the cooling air, a certain amount of the cooled air spills from within display cases 10 and because it is denser than the ambient air, it settles on and near floor 14 adjacent to cases 10. Typically, such spillover air is at a temperature of from about 30° F. to about 40° F. with non-frozen products and from about 0° F. to about 10° F. with frozen products.

It is a particular feature of the present invention that the cool spillover air from refrigerated display cases 10 is recovered before substantial mixing with ambient air has occurred and is utilized to subcool liquid refrigerant in conduit 31, and preferably also is utilized in the space air conditioning unit. To this end the inwardly offset wall portion 8 of display case 10 extending between the lower edge of front wall 18 and floor 14 is provided with openings indicated at 9 in the form of a plurality of longitudinally spaced slots or apertures communicating with a conduit 29 and fan 39 to provide a means to collect and withdraw the cooled air which spills over front wall 18 through opening 12 from within display cases 10. Such spillover air could cause discomfort on the part of shoppers if permitted to remain in the aisle space. However, it is a feature of this invention that such accumulation and resulting discomfort is prevented, and the cooling potential of the spillover air is effectively utilized, by the immediate removal of the spillover air through openings 9 and conduit means 29, which can be under the floor or underground and in the form of a duct, or the like, and by conducting the spillover air through conduit means 29 in heat exchange relation to a liquid refrigerant subcooling means 33 to a space air conditioning system 30.

Air conditioning means 30 can be mounted on the roof 31, and serves to provide the desired environmental conditions, eg 75° F. at 50% RH, within the store through a suitable distribution duct 32. While subcooling means 33 can be located in the space air conditioning unit 30, in FIG. 1 it is shown positioned within conduit means 29. Subcooling means 33 is adapted to carry liquid refrigerant and is interposed in the refrigerant conduit or line 31 from receiver 27 to expansion valves 20. The subcooling means can be in the form of a coil, if desired, which is connected as part of conduit 31 and extends into conduit means 29, or it can be any other type of heat exchanger operatively arranged to cause the transfer of heat from the liquid refrigerant in line 31 to the spillover air being drawn through conduit means 29 by fan 39.

The spillover air, whether initially at 0° F.–10° F. or at 30° F.–40° F., will have a temperature of from approximately 56° F. to approximately 60° F. as it reaches the subcooler 33. A relatively large volume of spillover air, for example 21,000 cfm typically is available to be drawn through conduit 29 by fan 39. The spillover air temperature is increased approximately 2° F.–4° F. as it passes subcooler 33, and therefore is at a relatively cool 58° F.–64° F. temperature as it reaches air conditioning system 30. At the same time, the liquid refrigerant passing through subcooler 33 on its way to expansion valves 20 is reduced in temperature from a subcooler inlet temperature of approximately 105° F. to 110° F. to a subcooler outlet temperature ranging from about 60° F. to about 66° F. This marked reduction in the temperature of the liquid refrigerant to such a subcooled condition substantially increases the efficiency of the refrigeration system by enabling a significantly greater heat absorption in evaporator 19 using the same amount of refrigerant, or, alternatively, by permitting the use of a smaller and therefore less costly system to obtain the same cooling capacity. Because of the refrigerant subcooling effects hereinabove described, the energy consumption of a given refrigeration system is estimated to be of the order of approximately 30% or so less than that of a conventional refrigeration system which does not have means for passing spillover air from the refrigerated display cases in heat exchange relation with a refrigerant subcooler before any substantial mixing of the spillover air with ambient air has occurred.

Figure 2:
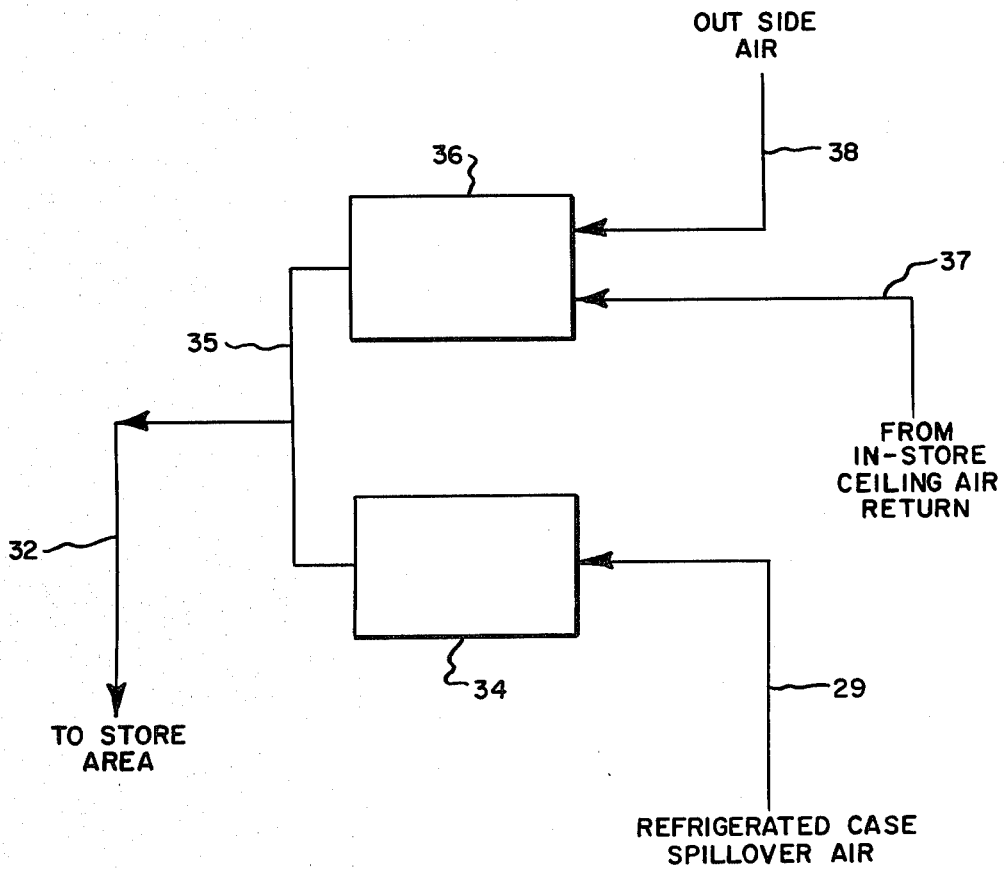
FIG. 2 is a schematic diagram of one form of air conditioning system which can be utilized in conjunction with a refrigeration system of the present invention in order to effectively utilize the available energy.

Preferably the spillover air is utilized in air conditioning system 30, one such system being illustrated schematically in FIG. 2. The air conditioning system shown therein comprises two separate units, the first air conditioning unit 34 receiving the spillover air which can be either heated or cooled, depending upon the season of the year, and then conveyed to a common header 35 to be mixed with the conditioned air emanating from a second air conditioning unit 36. The combined outputs from each system can thereafter be conveyed to the store area through distribution duct 32 for proper environmental control. Second air conditioning unit 36 utilizes two separate sources of input air. The first source is the in-store ambient air through conduit 37, and the second source is outside air through conduit 38. In operation, the in-store air and the outside air are mixed and conditioned to provide the proper environment. Controls, not shown, are provided to vary the relative amounts of in-store ambient air and outside air passing through unit 36, and to vary the relative amounts of conditioned air from units 34 and 36, to provide a proper balance for maximum efficiency in maintaining the desired space temperature and humidity in the store. Such controls can be of a type known in the art and the specific details thereof are not part of this invention.

The cool spillover air normally will be heated by first air conditioning unit 34 to the desired temperature and relative humidity level, whereas the air in second air conditioning unit 36 is either heated or cooled, depending upon the season. For example, during the summer, second unit 36 can provide approximately 30% of the volume of conditioned air, while first unit 34 provides approximately 70% to produce the desired environmental conditions. On the other hand, during the winter, for example, second unit 36 might provide only 20% of the air, while first unit 34 provides approximately 80%, because the outside air damper is preferably modulated to reduce the intake of outside air to zero flow as the outside temperature drops to 30° F. As indicated above, after proper conditioning, the conditioned air is conveyed to distribution duct 32 and subsequently distributed throughout the store to maintain comfortable temperatue and humidity conditions. It is estimated that using the spillover air in the space air conditioning system in this manner can reduce the energy consumption of a given air conditioning system by as much as approximately 60% as compared with a conventional system not using spillover air in this manner. It will be appreciated that conditioning units 34 and 36 could be replaced by a single unit having the three inlets 29, 37, 38, thereby eliminating header 35.

This it can be seen that the system of the present invention provides distinct advantages in that it permits subcooling of the liquid refrigerant to a considerably lower level because the cool spillover air is utilized directly, and it is not substantially mixed with higher temperature in-store air. Such a mixture would have a higher temperature than the spillover air alone, and the subcooling effect would be significantly reduced.

While particular embodiments of the present invention have been illustrated and described, it will be apparent to those skilled in the art that various changes and modifications can be made without departing from the spirit and scope of the present invention, and it is intended to cover in the appended claims all such changes and modifications that fall within the scope of the present invention.

What is claimed is:

1. The method of increasing the efficiency of a refrigeration system for a refrigerated display case having an evaporator associated therewith, the system also having means for conveying refrigerant to the evaporator, which comprises the steps of (a) recovering cooled spillover air from a refrigerated display case of the type permitting cooled air from within the case to spillover therefrom into the ambient space adjacent the case before substantial mixing with ambient air has occurred; and (b) conveying the recovered spillover air in heat exchange relation to the means for conveying refrigerant to the evaporator.

2. The method of claim 1, together with the further step of (c) thereafter utilizing the recovered spillover air in an air conditioning system for the space containing the case.

3. In a refrigeration system for cooling the air in at least one refrigerated product display case of the type permitting cooled air to spill over into the ambient space adjacent the case, the system including liquid refrigerant conveying means which conveys a liquid refrigerant to an evaporator associated with said refrigerated display case; the improvement comprising:

means for recovering cooled spillover air from a refrigerated product display case; and means for conducting said recovered spillover air in heat exchange relationship to the liquid refrigerant conveying means to cool the liquid refrigerant by said recovered spillover air.

4. A high efficiency refrigeration system comprising:

a refrigerated case from which cold air may spill;

an evaporator associated with said refrigerated case;

conveying means capable of conveying a liquid refrigerant to said evaporator; and means for recovering and conducting the spilled cold air in heat exchange relationship to said conveying means to cool said liquid refrigerant.

5. The high efficiency refrigeration system as set forth in claim 4 wherein the means for recovering and conducting the spilled cold air includes an air inlet positioned adjacent the base of the refrigerated case, conduit means for conducting the recovered spillover air away from the refrigerated case, and air moving means for moving the cooled spillover air through said conduit means.

6. The high efficiency refrigeration system as set forth in claim 5 wherein the conveying means includes a heat exchanger disposed within said conduit means.

7. The refrigeration system of claim 3 wherein said means for recovering cooled spillover air includes an air inlet opening positioned adjacent the base of said refrigerated product display case, and wherein said means for conducting said spillover air includes conduit means for conducting the recovered spillover air away from the display case and air moving means from moving the cooled spillover air through said conduit means.

8. The refrigeration system of claim 6, together with a space air conditioning system, the cooled spillover air being conducted to said air conditioning system by said conduit means.

9. The refrigeration system of claim 6 wherein the liquid refrigerant conveying means includes refrigerant subcooling means arranged in heat exchange relationship with said recovered cooled spillover air.

10. The refrigeration system of claim 9 wherein said subcooling means is positioned within said conduit means.

11. The refrigeration system of claim 8 wherein said air conditioning system comprises a first unit and a second unit, each of which discharges conditioned air to a common distributor, said first unit receiving said recovered cooled spillover air, and said second unit receiving ambient air.

12. The refrigeration system of claim 9 wherein a plurality of refrigerated product display cases are provided having air inlet openings positioned adjacent the bases thereof, and said conduit means includes separate conduits communicating with said air inlet openings adjacent the base of each of said display cases and with a common header communicating with said subcooling means and with a space air conditioning system.

* * * * *